United States Patent [19]

Finley

[11] 4,121,501

[45] Oct. 24, 1978

[54] FLOW COMBINING SYSTEM FOR DUAL PUMPS

[75] Inventor: Lloyd D. Finley, Lockport, Ill.

[73] Assignee: Caterpillar Tractor Co., Peoria, Ill.

[21] Appl. No.: 814,379

[22] Filed: Jul. 11, 1977

[51] Int. Cl.[2] ..... F15B 13/09

[52] U.S. Cl. ..... 91/519; 91/468; 60/420; 60/486

[58] Field of Search ..... 91/412, 444, 468; 60/420, 459, 486

[56] References Cited

U.S. PATENT DOCUMENTS

| | | | |
|---|---|---|---|
| 2,745,253 | 5/1956 | Towler et al. | 91/412 X |
| 3,386,344 | 6/1968 | Junck et al. | 91/414 |
| 3,535,877 | 10/1970 | Becker et al. | 60/422 |

*Primary Examiner*—Edgar W. Geoghegan

*Attorney, Agent, or Firm*—John W. Grant

[57] ABSTRACT

A fluid circuit connects a first pump to a first motor and has a control valve for controlling fluid flow to the first motor. The control valve is movable between a first position at which the first pump is blocked from communication with the first motor, a second position at which fluid flow to the motor is controllably modulated and a third position at which substantially the full output of the first pump is directed to the first motor. A valve device connects a second pump to the fluid circuit and is movable between a first position at which the second pump is in communication with a tank and a second position at which the output of the second pump is combined with the output of the first pump. The valve device is moved to the second position in response to the control valve being moved from said second position toward said third position.

8 Claims, 1 Drawing Figure

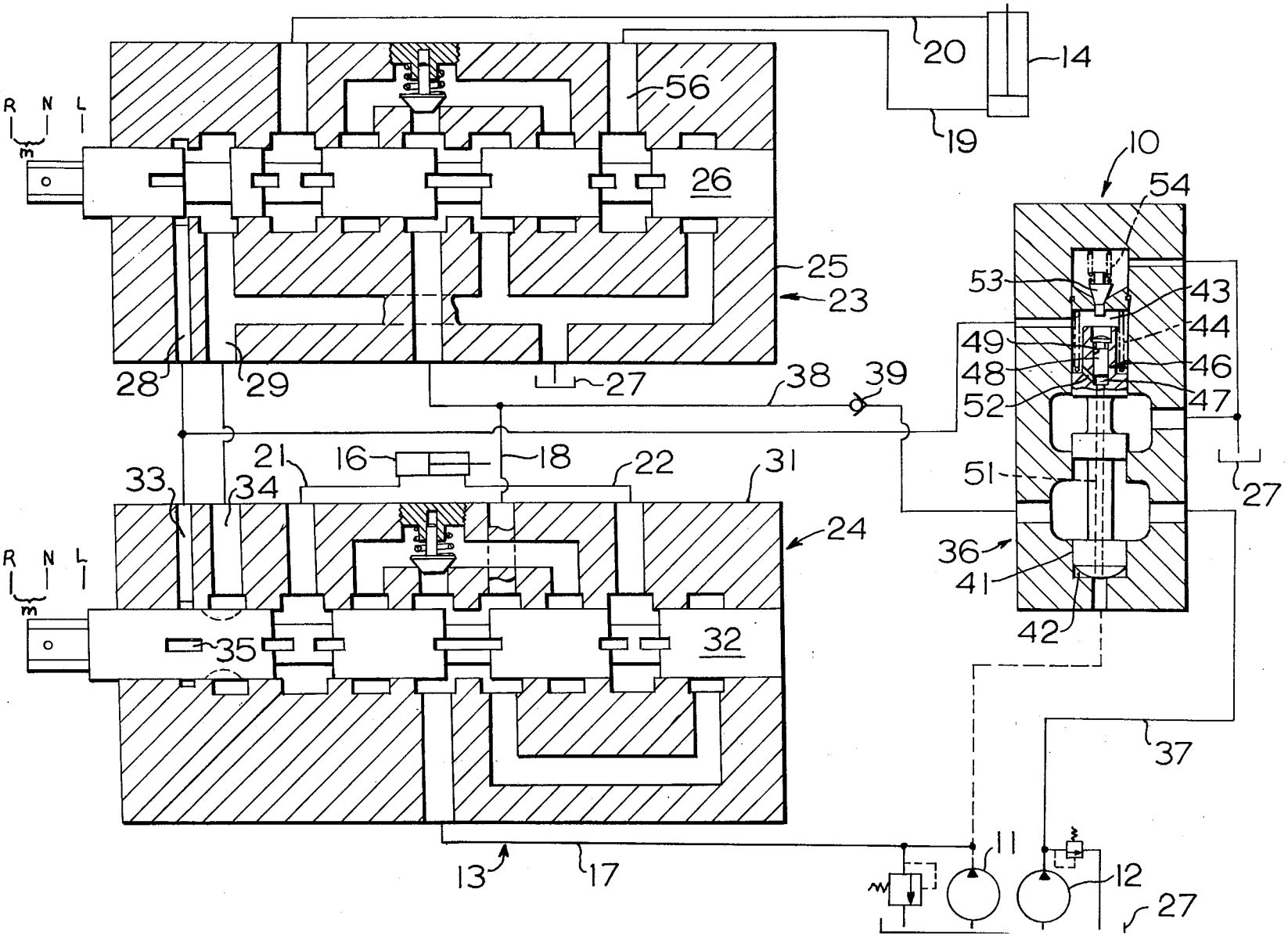
10
11
12
13
14
16
17
18
19
20
21
22
23
24
25
26
27
28
29
31
32
33
34
35
36
37
38
39
41
42
43
44
46
47
48
49
51
52
53
54
56
R
N
L
M

FLOW COMBINING SYSTEM FOR DUAL PUMPS

BACKGROUND OF THE INVENTION

Many hydraulic systems have a large capacity pump as the primary source of fluid for several control valves each of which controls fluid flow to one or more fluid motors. In some systems, a smaller capacity pump supplements the output of the larger pump until the fluid pressure of the system reaches a predetermined magnitude. One of the problems encountered with such systems is that, although the output of the small pump generally is needed for only the motor or motors controlled by one control valve or for only a small percentage of the time, the output of both pumps passes through the control valves when the fluid pressure is below the predetermined magnitude. This causes additional problems, particularly when fluid flow to the motors is being modulated by the control valves since the control valves must modulate the total output of both pumps and must be sized accordingly.

SUMMARY OF THE INVENTION

The present invention is directed to overcoming one or more of the problems as set forth above.

According to the present invention, a flow combining system for dual pumps has a first pump, a first double acting fluid motor, and a fluid circuit connecting the first pump to the first motor. The fluid circuit has a first control valve for controlling fluid flow therethrough to the first motor and is movable between a first position at which the pump is blocked from communication with the first motor, a second position at which fluid flow to the first motor is controllably modulated and a third position at which substantially the total output of the first pump is directed to the first motor. A valve means is connected to a second pump and to said fluid circuit and is movable between a first position at which the second pump is in communication with a tank and a second position at which the output of the second pump is combined with the output of the first pump. The valve means is moved to the second position in response to the first control valve being moved from said second position toward said third position.

BRIEF DESCRIPTION OF THE DRAWING

The sole FIGURE is a diagrammatic view of the apparatus of this invention.

DETAILED DESCRIPTION

Referring to the drawing, a flow combining system for dual pumps is generally indicated at 10 for selectively combining the fluid output of first and second pumps 11, 12 driven by an engine, not shown. A fluid circuit 13 connects the first pump to first and second fluid motors 14, 16. The fluid circuit can be conduits 17–22 and a pair of valve means 23, 24.

The valve means 23 can be, for example, a directional control valve 25 which controls fluid flow therethrough from the first pump 11 to and from the first fluid motor 14. The control valve has a valve member or spool 26 shown in a centered position indicated by the letter "N". At this position, fluid flow between conduit 18 and conduits 19 and 20 is blocked and the fluid is returned to a tank 27. The valve spool is movable between the centered position and a fully actuated position indicated by the letter "R". At this position the total output of the first pump 11 flowing through the conduit 18 passes through the control valve and is directed to the head end of the first motor 14. The valve spool has a plurality or range of modulating positions indicated by the letter "*m*" intermediate the centered position "N" and the fully actuated position "R". At each one of the modulating positions, the fluid flow from the first pump through the control valve to the head end of the motor is controllably modulated.

The control valve 25 also has a signal port 28 and a drain port 29. The signal port is in communication with the drain port at the centered position "N" of the valve spool 26 and remains in communication therewith when the valve spool 26 is moved to one of the modulating positions or to all operating positions to the right of the centered position. However, the signal port 28 is blocked from communication with the drain port 29 as the valve spool 26 is moved from the modulating position to the fully actuated position.

Valve means 24 can be, for example, a directional control valve 31 which controls fluid flow from the first pump 11 to and from the second fluid motor 16 and has a valve member or spool 32 shown in a centered position. At this position, fluid flow between conduit 17 and conduits 21 and 22 is blocked and conduit 17 is in communication with conduit 18 for passing the output of the first pump through the conduit 18 to the directional control valve 25. Movement of the valve spool 32 from the centered position to the right directs the fluid to the head end of the second motor 16 while movement of the valve spool from the centered position to the left directs fluid flow to the rod end of the second motor.

The control valve 31 has a signal port 33 and a drain port 34. At the centered position of the valve spool 32, the signal port 33 is blocked from communication with the drain port 34. Movement of the valve spool 32 in either direction from the centered position establishes communication between the signal port 33 and the drain port 34 through slots 35 in the valve spool.

A combining valve means 36 is connected to the second pump 12 through a conduit 37 and to the conduit 18 through a conduit 38 and a check valve 39. A valve member 41 is movable between a first position at which the second pump 12 is in communication with the tank 27 and a second position at which the second pump is blocked from communication with the tank and is in communication with the conduit 18 for combining the output of the second pump 12 with the output of the first pump 11 in the conduit 18. The check valve 39 prevents fluid from passing from the conduit 18 to the valve means 36.

A chamber 42 at one end of the valve member 41 is connected to the conduit 17 of the fluid conduit 13. A signal chamber 43 at the other end of the valve member is connected to the signal ports 28, 33 of both control valves 25, 31. A biasing means, for example, a spring 44 positioned in the signal chamber 43, urges the valve member 41 to the second position. A piston means 46 has a chamber 47 at one end of a piston 48 which is slidably positioned within a bore 49 of the valve member 41. A passageway 51 in the valve member connects chamber 42 with chamber 47. A flow restrictor or orifice 52 connects passageway 51 and chamber 47 with signal chamber 43.

A poppet valve 53 is connected to the signal chamber 43 and is movable between a closed position at which the signal chamber is blocked from communication with the tank 27 and an open position at which the signal chamber is in communication with the tank. A spring 54 biases the poppet valve to the closed position and is of a size sufficient for allowing the poppet valve to move to its open position in response to the fluid pressure in signal chamber 43 exceeding a preselected magnitude.

The conduit 38 alternatively can be connected directly to a motor port 56 of the control valve 25 or directly to the conduit 19. When either of these connections are made, the conduit 37 is also connected to the conduit 17 through a check valve to permit the fluid output of the second pump to pass through the conduit 17 when the valve member 41 is at the second position during the initial startup of the system.

In the operation of this apparatus, the valve member 41 of the valve means 36 is moved to the second position by the biasing force of spring 44 when the signal chamber 43 is blocked from communication with the tank and the fluid pressure in chambers 42 and 43 is substantially equal. The valve member is moved to its first position when the signal chamber 43 is in communication with the tank 27. With the signal chamber in communication with the tank, fluid passing through the passageway 51 from chamber 42 passes through the orifice 52 causing a pressure drop across the orifice with the resulting pressure differential between chambers 42 and 43 being sufficient for the pressurized fluid in chamber 42 to move the valve member 41 to the first position in opposition to the biasing force of the spring 44.

When neither of the fluid motors 14, 16 are being operated, the valve spools 26, 32 of the control valves 25, 31 are in their centered positions as shown in the drawing. Thus, with signal port 28 in communication with the drain port 29, the signal chamber 43 is vented to tank 27 and the valve member 41 of valve means 36 is at the second position. Although the first pump 11 is in communication with the tank 27 through the control valves 25, 31, the valves and conduits offer resistance to fluid flow sufficient to generate a fluid pressure in the chamber 42 to move the valve member 41 to the first position.

The signal port 28 remains in communication with the drain port 29 when valve spool 26 is moved to one of its modulating positions and thus the valve member 41 of valve means 36 remains in its first position. However, moving the valve spool 26 from the modulating position to its fully actuated position "R" progressively blocks communication between the signal port 28 and drain port 29 causing the valve member 41 to move to the second position at which the output of the second pump 12 is combined with the output of the first pump 11.

Should the pressure in the fluid circuit 13 and thus in chambers 42, 43, 47 exceed a preselected magnitude, the pressurized fluid in the chamber 43 unseats the poppet valve 53 thereby communicating chamber 43 with the tank 27. Thus, the valve member 41 is moved to the first position in response to the fluid pressure in the fluid circuit exceeding the preselected magnitude.

A pressure differential across the orifice 52 between chambers 47, 43 is also created by the poppet valve 53 being moved to its opened position and the higher fluid pressure in chamber 47 results in the piston 48 being moved into abutment with the poppet valve and holding the poppet valve in the opened position for a time sufficient for the fluid pressure in the chamber 47 to decrease to a second preselected magnitude at which time the poppet valve will be moved to its closed position by the spring 54.

Moving the valve spool 32 of the control valve 31 to an operating position in either direction communicates the signal port 33 with the drain port 34 to vent the signal chamber 43. Thus, with valve spool 32 in an operating position, the valve member 41 of valve means 36 will move to or remain in the first position even though the valve spool 26 of control valve 25 is moved to or is in its fully actuated position.

Other aspects, objects and advantages of this invention can be obtained from a study of the drawing, the disclosure and the appended claims.

The embodiment of the invention in which an exclusive property or privilege is claimed are defined as follows:

1. A flow combining system for dual pumps, comprising:

a first pump;

a first double acting fluid motor;

a fluid circuit connecting the first pump to the first motor, said fluid circuit having a first control valve for controlling fluid flow therethrough to the first motor, said first control valve being movable between a first position at which the first pump is blocked from communication with the first motor, a second position at which fluid flow through the first control valve is controllably modulated and a third position at which substantially the total output of the first pump is directed through the first control valve to the first motor;

a second pump; and valve means connected to said second pump and to said fluid circuit, said valve means being movable between a first position at which the second pump is in communication with a tank and a second position at which the second pump is blocked from communication with the tank and the output of the second pump is combined with the output of the first pump, said valve means being moved to the second position in response to the first control valve being moved from said second position toward said third position.

2. The system of claim 1 wherein said valve means has a first chamber and a valve member movable to the second position in response to pressurized fluid in said first chamber.

3. The system of claim 2 wherein said first control valve has a drain port, a first signal port connected to the first chamber of the valve means, and a movable valve spool, said first signal port being in communication with the drain port at the second position of the first control valve and said first signal port being blocked from communication with the drain port at the third position of the first control valve.

4. The system of claim 3 wherein said valve means includes biasing means urging the valve member to the second position, a second chamber at one end of the valve member and connected to said fluid circuit, and a flow restrictor connecting the second chamber with the first chamber.

5. The system of claim 4 including poppet valve means connected to the first chamber and being movable to an opened position in response to the fluid pressure in the first chamber exceeding a first preselected magnitude.

6. The system of claim 5 including piston means responsive to the fluid pressure in the second chamber for holding the poppet valve means in the opened position for a time sufficient for the fluid pressure in the first chamber to decrease to a second preselected magnitude.

7. The system of claim 2 including a second fluid motor, said fluid circuit including a third control valve positioned intermediate the first pump and the first control valve and being movable between a first position at which fluid flow from the first pump passes through the third control valve to the first control valve and a second position at which the output of the first pump is directed to the second fluid motor, said third control valve having means for venting the first chamber at the second position of the third control valve.

8. The system of claim 1 including means positioned between said valve means and said fluid circuit for blocking fluid flow from the fluid circuit to the valve means.

* * * * *